US007824053B2

(12) United States Patent
Maier, Sr.

(10) Patent No.: US 7,824,053 B2
(45) Date of Patent: Nov. 2, 2010

(54) TATTLETALE CAP

(76) Inventor: Larry Wayne Maier, Sr., 206 S. Davis Ave., Columbus, OH (US) 43222

( * ) Notice: Subject to any disclaimer, the term of this patent is extended or adjusted under 35 U.S.C. 154(b) by 0 days.

(21) Appl. No.: 11/242,416

(22) Filed: Dec. 6, 2005

(65) Prior Publication Data

US 2007/0127232 A1 Jun. 7, 2007

(51) Int. Cl.
*F21V 21/084* (2006.01)

(52) U.S. Cl. ..... 362/106; 362/812; 40/329

(58) Field of Classification Search ..... 362/105, 362/106, 570, 812; 340/815.45; 40/329
See application file for complete search history.

(56) References Cited

U.S. PATENT DOCUMENTS 5,111,366 A * 5/1992 Rife et al. ..... 362/605
5,680,718 A * 10/1997 Ratcliffe et al. ..... 40/329
5,722,192 A * 3/1998 Salley ..... 40/329
5,921,674 A * 7/1999 Koczi ..... 362/800
6,167,570 B1 * 1/2001 Su ..... 2/209.13
6,168,286 B1 * 1/2001 Duffy ..... 362/106
6,733,150 B1 * 5/2004 Hanley ..... 362/106
6,752,510 B1 * 6/2004 Appiah ..... 362/106
7,052,154 B2 * 5/2006 Vanderschuit ..... 362/105
7,182,478 B2 * 2/2007 Marston ..... 362/106
7,229,385 B2 * 6/2007 Freeman et al. ..... 482/4
2002/0186557 A1 * 12/2002 Lary et al. ..... 362/106
2006/0198122 A1 * 9/2006 Senter et al. ..... 362/105

* cited by examiner

*Primary Examiner*—Stephen F. Husar
*Assistant Examiner*—Peggy A. Neils
(74) *Attorney, Agent, or Firm*—Ariel S. Bentolila; Bay Area IP Group, LLC

(57) ABSTRACT

A baseball cap with a programmable tight emitting diode screen attached to the crown of the headgear. The sign would display the desired message either preprogrammed or input directly by the wearer.

1 Claim, 1 Drawing Sheet

TATTLETALE CAP

CROSS-REFERENCE TO RELATED APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to headwear with signs. More specifically, a scrolling programmable light emitting diode sign attached to a ball cap, hat, or other headwear.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
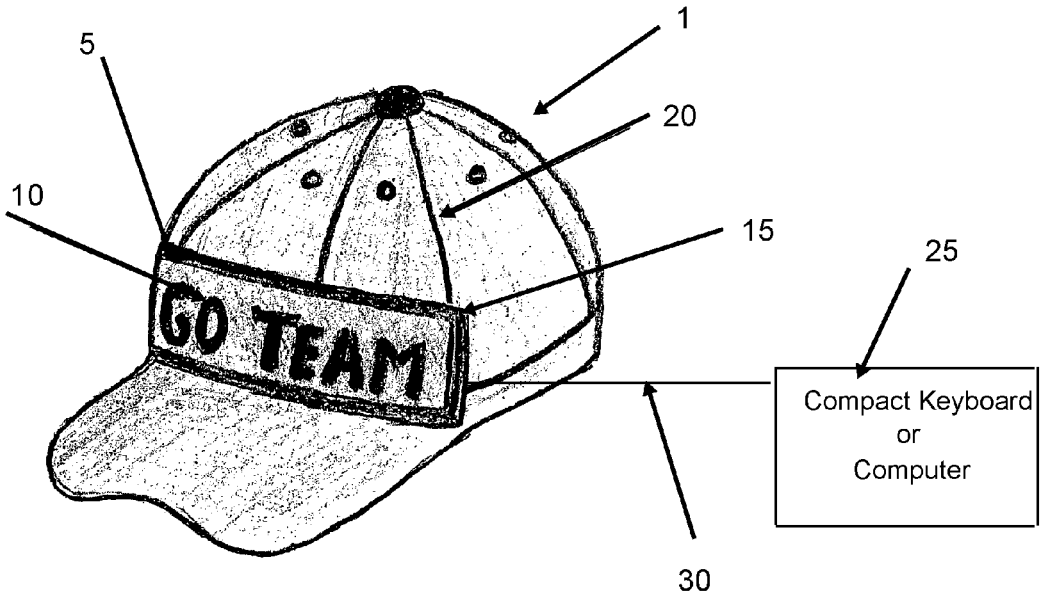
FIG. 1 illustrates an exemplary headwear with a programmable light emitting diode sign in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, tattletale cap is presented.

A baseball hat with a programmable light emitting diode display is affixed to a baseball cap or any other headwear. It can be used for business or recreational. This invention is useful in advertising or to convey any message the user would like to display to others.

Other features, advantages, and objects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein. The present invention will now be described in detail with reference to embodiments thereof as illustrated in the accompanying drawings.

In some preferred embodiments a scrolling programmable light emitting diode sign is attached to a ball cap, hat, or other headwear. The light emitting diode sign could be programmed by user, by means of a compact keyboard attached by wire to the light emitting diode sign or by computer. The light emitting diode sign would be approximately 2 inches by 5 inches and attached to hat by means of snaps, zipper pouch, Velcro et cetera. The letters would be large enough to read from a short distance.

FIG. 1 illustrates an exemplary headwear with a programmable light emitting diode sign in accordance with an embodiment of the present invention. A light emitting sign for a hat 1 consists of a programmable light emitting diode sign 5 comprising a generally flat structure containing a display area 10 actively displaying a message consisting of alphanumeric characters programmed by a wearer of hat 1. Programmable light emitting diode sign 5 is configured with an attachment means 15 for removably attaching a back side of programmable light emitting diode sign 5 to a front portion of a crown 20 of hat 1 where the front portion is comprised of a generally pliable material. Programmable light emitting diode sign 5 is self-contained for displaying the message and removable from hat 1 to be subsequently attached to another suitable hat. The programmable light emitting diode sign 5 is further configured with dimensions allowing programmable light emitting diode sign 5 to substantially extend across an entire portion of crown 20 that is visible from a front of hat 1 when being worn by the wearer. The dimensions further have a height that is sufficient for viewing the message from a distance. Programmable light emitting diode sign 5 is further configured for programming from a compact keyboard 25 where the wearer can program the message into programmable light emitting diode sign 5 using compact keyboard 25. The message is scrolled across programmable light emitting diode sign 5 enabling the wearer to convey the message to viewers within the distance.

The invention is thus to cover all modifications, equivalents, and alternatives falling within the spirit and scope of the following claims.

The invention claimed is:

1. A light emitting sign for a hat consisting of:

a programmable light emitting diode sign comprising a generally flat structure containing a display area actively displaying a message consisting of alphanumeric characters programmed by a wearer of the hat, said programmable light emitting diode sign being configured with an attachment means for removably attaching a back side of said programmable light emitting diode sign to a front portion of a crown of the hat where said front portion is comprised of a generally pliable material, wherein said programmable light emitting diode sign is self-contained for displaying said message and removable from the hat and to be subsequently attached to another suitable hat, said programmable light emitting diode sign further being configured with dimensions allowing said programmable light emitting diode sign to substantially extend across an entire portion of the crown that is visible from a front of the hat when being worn by the wearer, said dimensions further having a height that is sufficient for viewing said message from a distance, said programmable light emitting diode sign further being configured for programming from a compact keyboard where the wearer can program said message into said programmable light emitting diode sign using the compact keyboard, wherein said message is scrolled across said programmable light emitting diode sign enabling the wearer to convey said message to viewers within said distance.

* * * * *